US009932762B2

(12) United States Patent
Hayashi et al.

(10) Patent No.: US 9,932,762 B2
(45) Date of Patent: Apr. 3, 2018

(54) DOOR-EQUIPPED HOUSING

(71) Applicant: Mitsubishi Electric Corporation, Tokyo (JP)

(72) Inventors: Shoichiro Hayashi, Tokyo (JP); Hirohisa Naguchi, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 15/502,249

(22) PCT Filed: Oct. 31, 2014

(86) PCT No.: PCT/JP2014/079112
§ 371 (c)(1),
(2) Date: Feb. 7, 2017

(87) PCT Pub. No.: WO2016/067466
PCT Pub. Date: May 6, 2016

(65) Prior Publication Data

US 2017/0226783 A1 Aug. 10, 2017

(51) Int. Cl.
*E05C 19/12* (2006.01)
*E05B 65/06* (2006.01)

(52) U.S. Cl.
CPC ..... *E05C 19/12* (2013.01); *E05B 65/06* (2013.01)

(58) Field of Classification Search
CPC ..... E05C 19/06; E05C 19/063; E05C 19/066; E05C 19/188; E05C 19/12; E05C 19/08;
(Continued)

(56) References Cited

U.S. PATENT DOCUMENTS 4,138,151 A * 2/1979 Nakao ..... E05C 19/066 292/341.12
4,344,646 A * 8/1982 Michel ..... A45C 13/1084 220/326
(Continued)

FOREIGN PATENT DOCUMENTS

AT 300606 B * 8/1972 ..... E05C 19/066
DE 1107554 B * 5/1961 ..... E05C 19/066
(Continued)

OTHER PUBLICATIONS

International Search Report of PCT/JP2014/079112, dated Jan. 13, 2015. [PCT/ISA/210].
(Continued)

*Primary Examiner* — Andrew M Roersma
(74) *Attorney, Agent, or Firm* — Sughrue Mion, PLLC; Richard C. Turner

(57) ABSTRACT

A door-equipped housing includes a box body having an opening formed on one side thereof, and a door to close the opening, the door being supported by the box body to be rotatable about a rotational axis. The box body has a projecting portion formed on an inside of a wall of the box body extending from the opening toward a deep side of the box body. The door includes a hook portion to engage the projected portion for preventing the door from opening, the hook portion being located on a deeper side of the box body than the projecting portion as the door closes the opening, and a flexible part extending in a direction away from a surface of the wall having the projected portion formed thereon as the door closes the opening. The flexible part bends together with a movement of the hook portion to climb over the projecting portion during an opening/closing operation of the door.

9 Claims, 14 Drawing Sheets

(58) Field of Classification Search
CPC .... Y10S 292/11; Y10S 292/16; Y10S 292/38; Y10T 292/0809; Y10T 292/0813; Y10T 292/0817; Y10T 292/082; Y10T 292/0821; Y10T 292/0825; Y10T 292/083; Y10T 292/0894; Y10T 292/0895; Y10T 292/08; Y10T 292/0902; Y10T 292/0905; Y10T 292/0907
USPC ..... 220/326
See application file for complete search history.

(56) References Cited

U.S. PATENT DOCUMENTS

| | | | | | |
|---|---|---|---|---|---|
| 4,964,661 | A * | 10/1990 | Cadwell | E05C 19/06 | 292/337 |
| 5,645,304 | A * | 7/1997 | Richardson | E05B 65/0014 | 292/1 |
| 6,921,227 | B1 * | 7/2005 | De Jong | B60J 7/192 | 292/80 |
| 2010/0236825 | A1 | 9/2010 | Nagatomo et al. | | |
| 2012/0187812 | A1 * | 7/2012 | Gerst | E05C 19/06 | 312/237 |

FOREIGN PATENT DOCUMENTS

| | | | | |
|---|---|---|---|---|
| DE | 2160775 | A1 * | 6/1973 | E05C 19/066 |
| DE | 2544267 | A1 * | 4/1977 | E05C 19/066 |
| FR | 1331403 | A * | 7/1963 | A47B 95/02 |
| GB | 691166 | A * | 5/1953 | E05C 19/063 |
| JP | 44-8482 | Y1 | 4/1969 | |
| JP | 51-100827 | U | 8/1976 | |
| JP | 59-000269 | U | 1/1984 | |
| JP | 11-172984 | A | 6/1999 | |
| JP | 2002072599 | A | 3/2002 | |
| JP | 2005-155016 | A | 6/2005 | |
| JP | 2011-21442 | A | 2/2011 | |

OTHER PUBLICATIONS

Communication dated Dec. 12, 2017 from the German Patent Office in counterpart German application No. 11 2014 007 009.2.

* cited by examiner

DOOR-EQUIPPED HOUSING

CROSS REFERENCE TO RELATED APPLICATIONS

This application is a National Stage of International Application No. PCT/JP2014/079112 filed Oct. 31, 2014, the contents of all of which are incorporated herein by reference in their entirety.

FIELD

The present invention relates, to a door-equipped housing in which a door rotatable about a rotational axis closes an opening of the casing.

BACKGROUND

A door-equipped housing in which a door rotatable about a rotational axis closes an opening formed in a box body has been used hitherto. Patent Literature 1 discloses a structure including a hook formed on a door to engage a projecting portion formed on a box body so that the door keeps closing an opening. The structure disclosed in Patent Literature 1 enables the door to stably keep closing the opening, and facilitates the opening/closing operation of the door.

CITATION LIST

Patent Literature

Patent Literature 1: Japanese Patent Application Laid-Open No. 2011-021442

SUMMARY

Technical Problem

There are demands that the box body of the above door-equipped housing be thinner. Further, the structure of the door-equipped housing is required to enable the door to stably keep closing the opening as well as to smoothly open and close.

The present invention has been made in view of the foregoing, and an object of the present invention is to provide a door-equipped housing that enables a door to stably keep closing an opening of a box body as well as to smoothly open and close even if the box body is thinned.

Solution to Problem

To solve the above problem and achieve the object, the present invention provides A door-equipped housing comprising: a box body having an opening formed on one side thereof; and a door to close the opening, the door being supported by the box body to be rotatable state about a rotational axis wherein the box body has a projecting portion formed on an inside of a wall surface of the box body, the wall surface extending from the opening toward a deep side of the box body, and the door includes: a hook portion to engage the projecting portion for preventing the door from opening, the hook portion being located on a deeper side of the box body than the projecting portion as the door closes the opening; and a flexible part extending in a direction away from the wall surface having the projecting portion formed thereon as the door closes the opening, and the flexible part bends together with a movement of the hook portion to climb over the projecting portion during an opening/closing operation of the door.

Advantageous Effects of Invention

The door-equipped housing according to the present invention provides an effect capable of stably keeping a door in a state of closing an opening, and capable of facilitating the opening/closing of the door, in a compatible manner, even if the thickness of its box body is reduced.

DESCRIPTION OF EMBODIMENTS

Exemplary embodiments of a door-equipped housing according to the present invention will be explained below in detail with reference to the accompanying drawings. The present invention is not limited to the following embodiments.

First Embodiment

Figure 1:
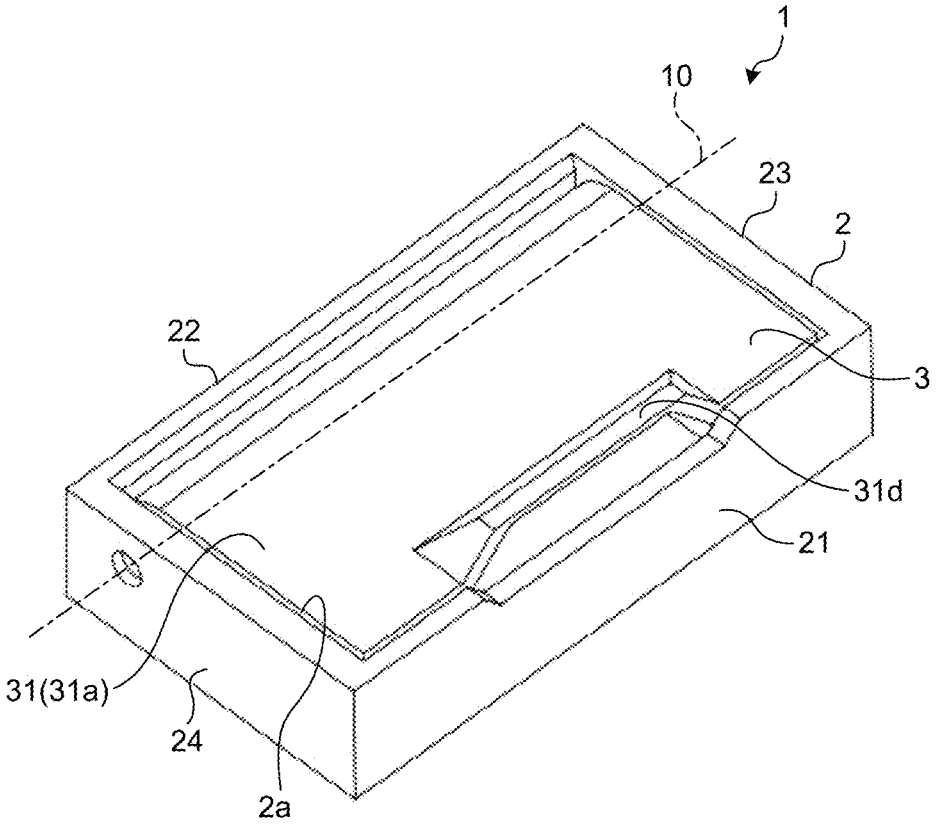
FIG. 1 is an exterior perspective view illustrating a door-equipped housing according to a first embodiment of the present invention.
Figure 2:
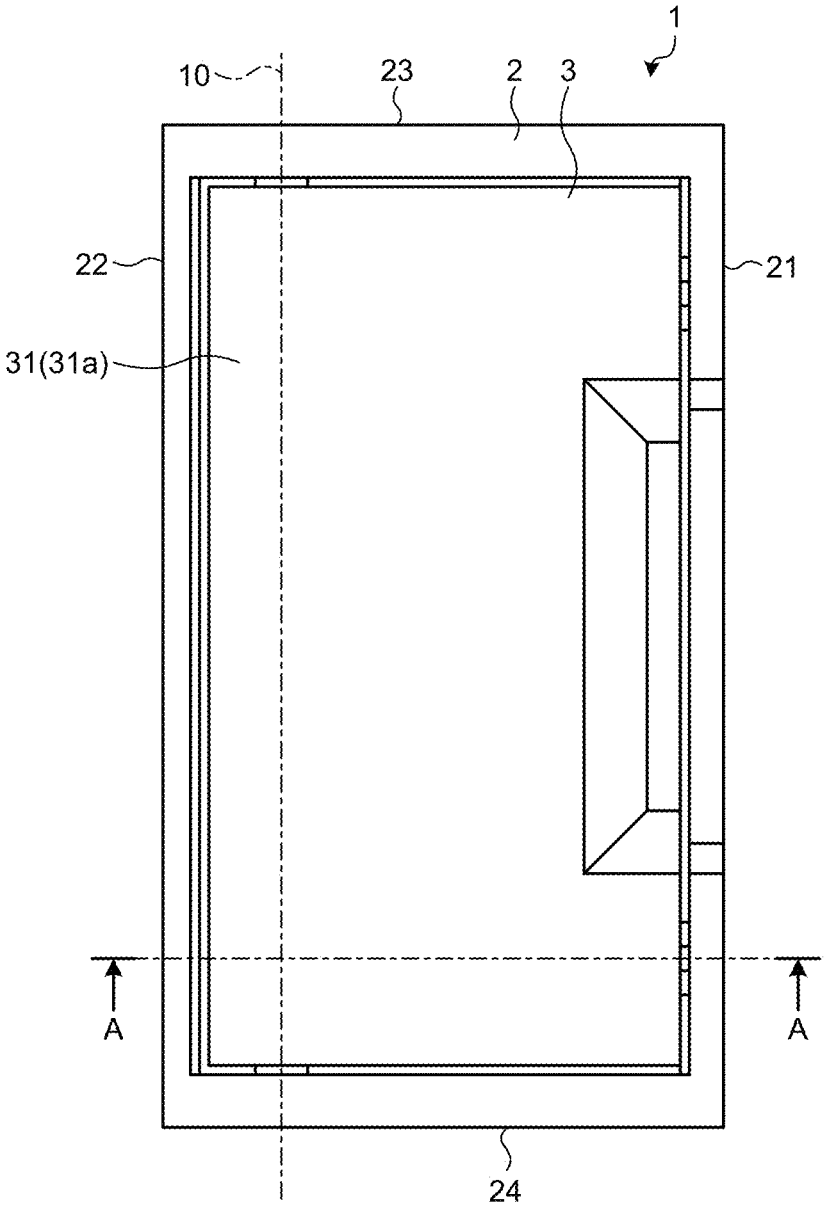
FIG. 2 is a plan view of the door-equipped housing illustrated in FIG. 1 in the first embodiment.
Figure 3:
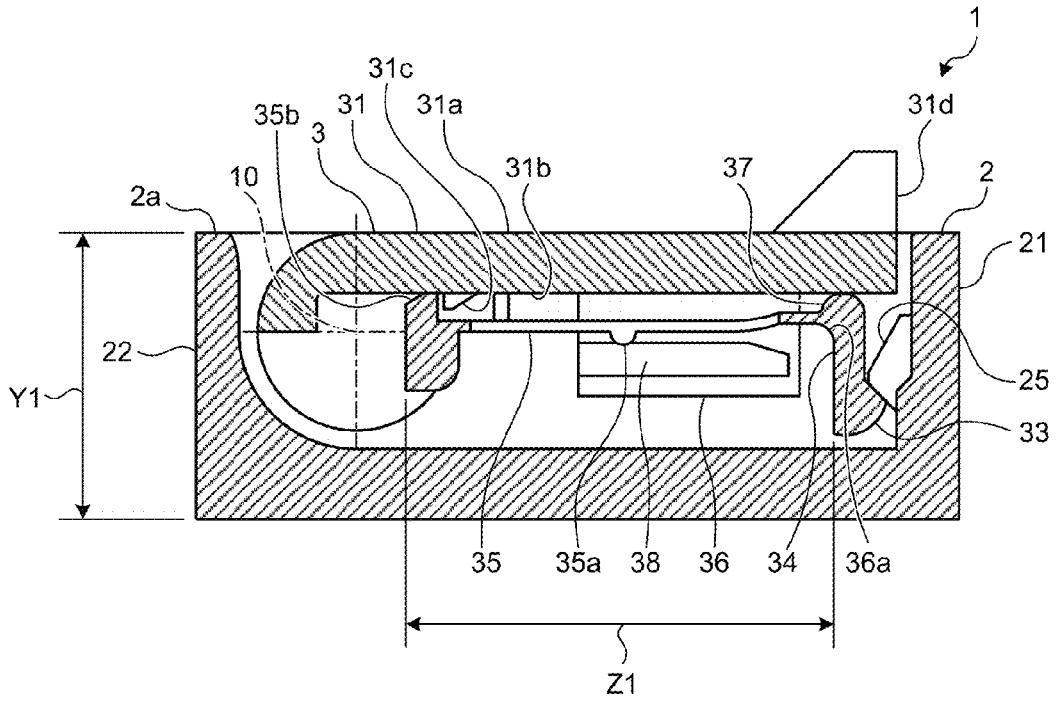
FIG. 3 is a sectional view taken along line A-A indicated in FIG. 2 in the first embodiment.
Figure 4:
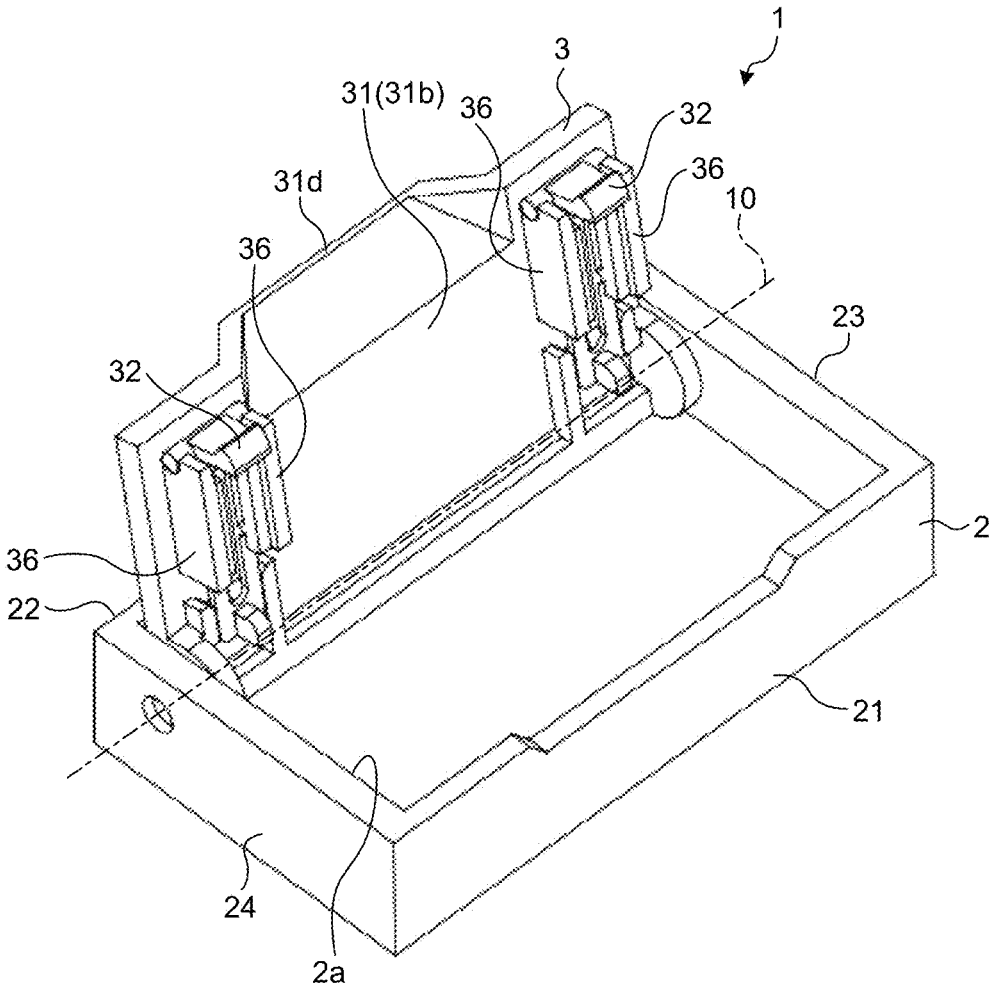
FIG. 4 is a view illustrating a state where the door of the door-equipped housing illustrated in FIG. 1 in the first embodiment is open.

FIG. 1 is an exterior perspective view illustrating a door-equipped housing according to a first embodiment of the present invention. FIG. 2 is a plan view of the door-equipped housing illustrated in FIG. 1 in the first embodiment. FIG. 3 is a sectional view taken along line A-A indicated in FIG. 2 in the first embodiment. FIG. 4 is a view illustrating a state where the door of the door-equipped housing illustrated in FIG. 1 in the first embodiment is opened.

The door-equipped housing 1 includes a box body 2 having an opening 2*a* formed on one side thereof, and a door 3 to close the opening 2*a*. The box body 2 has a rectangular parallelepiped shape as a whole, and the opening 2*a* has a rectangular shape as viewed in plan. The box body 2 is formed with a first wall 21, a second wall 22, a third wall 23, and a fourth wall 24, which surround the opening 2*a*. The first wall 21, the second wall 22, the third wall 23, and the fourth wall 24 extend from the opening 2*a* toward a deep side of the box body 2.

The box body 2 supports the door 3 such that the door 3 can rotate about a rotational axis 10 extending to the third wall 23 and the fourth wall 24. By rotating about the rotational axis 10, the door 3 can move between a position to close the opening 2*a* and a position to open the opening 2*a*. A projecting portion 25 is formed inside the first wall 21 that faces a free end of the door 3 distant from the rotational axis 10 as the door 3 closes the opening 2*a*.

Figure 5:
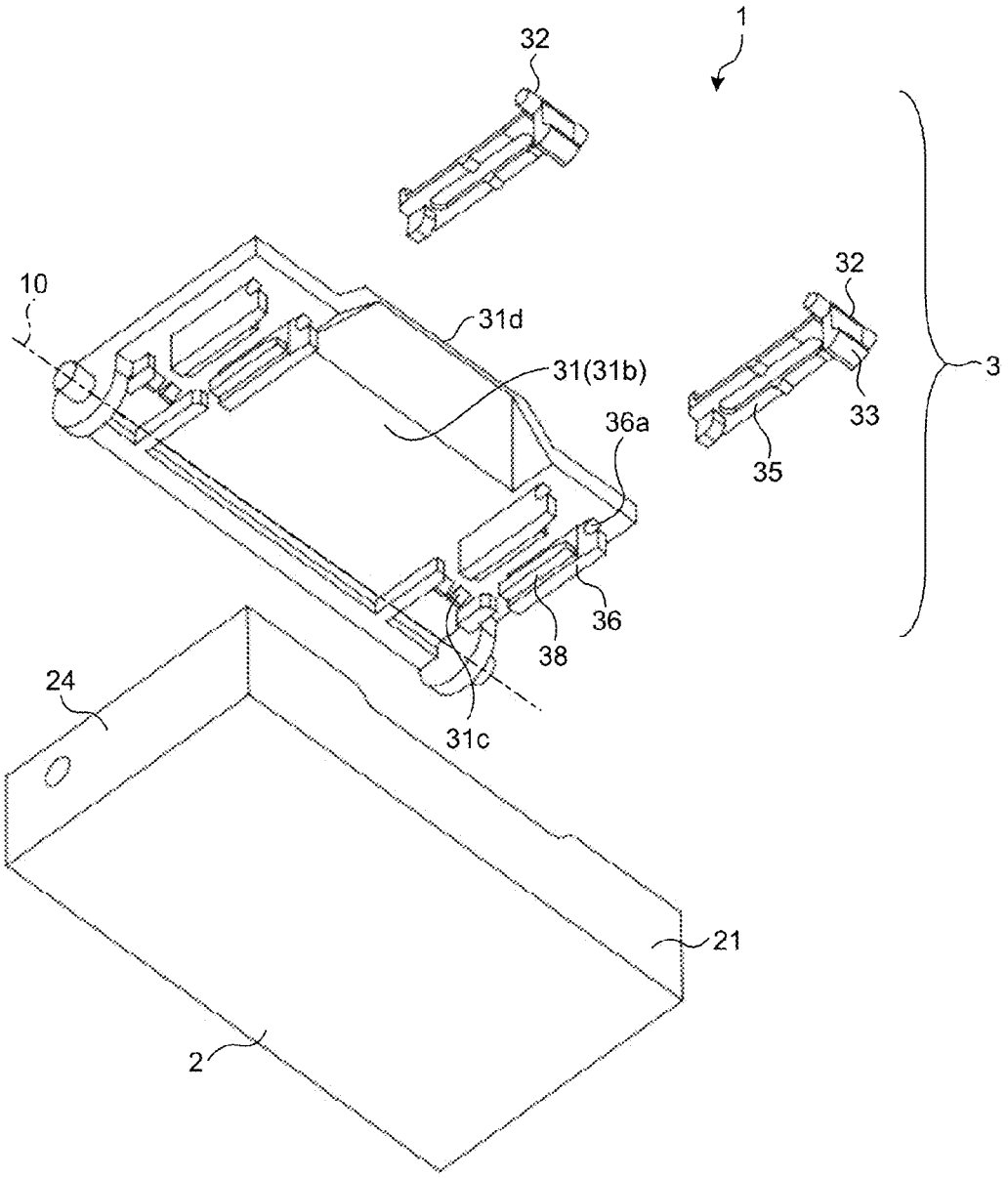
FIG. 5 is an exploded perspective view of the door-equipped housing illustrated in FIG. 1 in the first embodiment, as the housing is viewed from a side of a bottom surface thereof.

FIG. 5 is an exploded perspective view of the door-equipped housing 1 illustrated in FIG. 1 in the first embodiment, as the housing 1 is viewed from a side of a bottom surface thereof. The door 3 includes a door body 31 and hook members 32. The door body 31 has a plate-shape to close the opening 2*a* of the box body 2. The door body 31 has a front surface 31*a* and a back surface 31*b* that face the outside and the inside, respectively, as the door body 31 closes the opening 2*a*. The hook members 32 are supported on the back surface 31*b* of the door body 31. A knob member 31*d* is formed on a side of the front surface 31*a* of the door body 31 such that fingers can engage the knob member 31*d* when opening the door 3.

Figure 6:
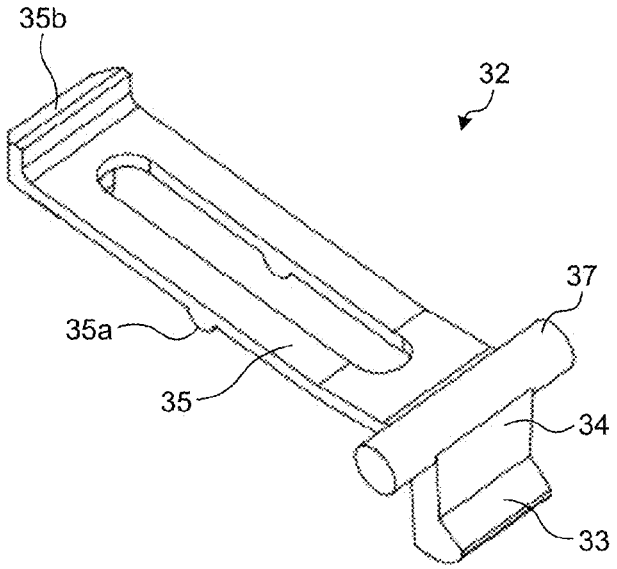
FIG. 6 is a perspective view of a hook member in the first embodiment.

FIG. 6 is a perspective view of the hook member 32 in the first embodiment. The hook member 32 has a hook portion 33 formed thereon, and the hook portion 33 is located on a deeper side than the projecting portion 25 formed on the first wall 21 of the box body 2 and engages the projecting portion 25 as the door 3 closes the opening 2*a*. The hook member 32 includes a hook support portion 34 extending from the hook portion 33 toward the door body 31.

The hook member 32 includes an elastic part 35 extending from an end of the hook support portion 34 on a side of the door body 31 in a direction parallel with the opening 2*a* away from the surface of the first wall 21 having the projecting portion 25 formed thereon as the door 3 closes the opening 2*a*. The elastic part 35 is a flexible part to bend when the door 3 is opened.

At a connecting portion between the hook support portion 34 and the elastic part 35, a protruding fulcrum portion 37 is formed on a side closer to the door body 31 than the elastic part 35. Since the fulcrum portion 37 protrudes toward the door body 31, a gap is defined between the elastic part 35 and the door body 31. The elastic part 35 is formed longer than the hook support portion 34 and formed thinner than the hook support portion 34, and thus the elastic part 35 can be elastically deformed more easily than the hook support portion 34. As illustrated in FIG. 6, an opening may be formed in the elastic part 35 so that the elastic part 35 can be elastically deformed more easily. Forming the opening in the elastic part 35 reduces the material.

Figure 7:
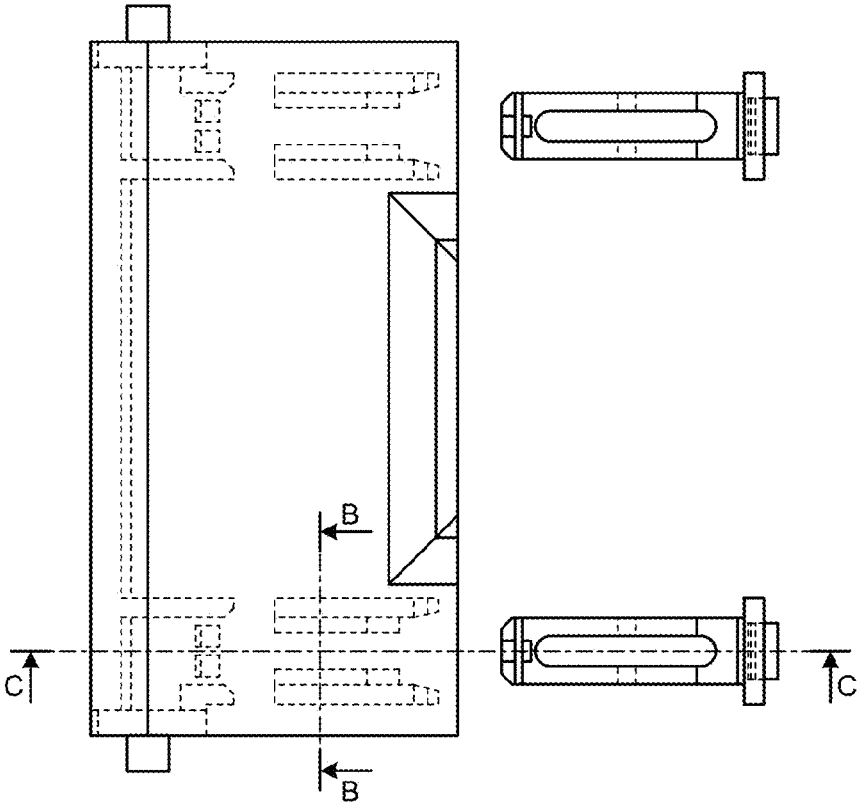
FIG. 7 is a view of the door in the first embodiment, as the door is viewed from a side of a front surface of a door body, illustrating a state where hook members are dismounted from the door body.
Figure 8:
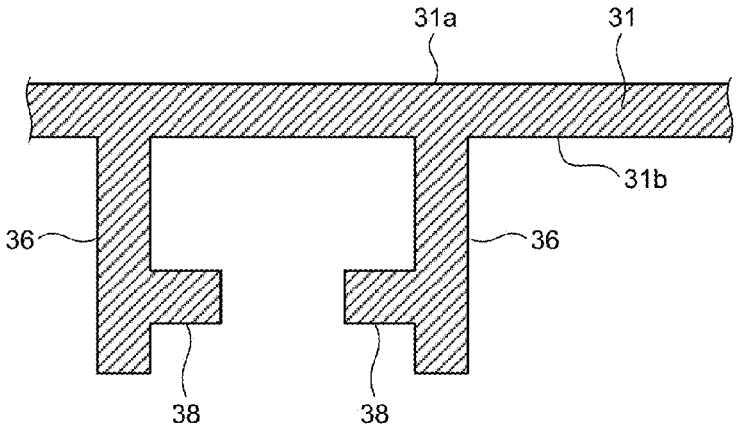
FIG. 8 is a sectional view taken along line B-B indicated in FIG. 7 in the first embodiment.

FIG. 7 is a view of the door 3 in the first embodiment, as the door 3 is viewed from the side of the front face 31*a* of the door body 31, illustrating a state where the hook members 32 are dismounted from the door body 31. FIG. 8 is a sectional view taken along line B-B indicated in FIG. 7 in the first embodiment. On the back surface 31*b* of the door body 31, support walls 36 to sandwich the elastic part 35 of the hook member 32 from the opposite sides are formed in an opposed relationship with each other. The support walls 36 extend in a direction from the first wall 21 toward the second wall 22, i.e., in a direction perpendicular to the rotational axis 10. The support wall 36 has a separation regulating portion 38 formed thereon, and the separation regulating portion 38 protrudes toward the opposite support wall 36. The separation regulating portions 38 and the rear face 31*b* of the door body 31 define a gap therebetween.

The elastic part 35 of the hook member 32 is inserted between the door body 31 and the separation regulating portions 38. The separation regulating portions 38 abut on the elastic part 35 from a side opposite to the door body 31 with the elastic part 35 held between the door body 31 and the separation regulating portions 38, and regulate the movement of the elastic part 35 in a direction away from the door body 31. The separation regulating portions 38 are formed shorter than the entire length of the elastic part 35, such that the separation regulating portions 38 face the elastic part 35 in a given range of the elastic part 35 from its end on a side of the hook support portion 34 and do not face the elastic part 35 in a given range of the elastic part 35 from its end opposite to the side of the hook support portion 34.

The support wall 36 has its end located on a side of the first wall 21 as the opening 2*a* is closed by the door 3, and this end of the support wall 36 is a connected portion to the door body 31. The connected portion has a concave portion 36*a* formed thereon, the concave portion 36*a* is recessed toward the rotational axis 10. The concave portion 36*a* is a door-side support portion to support the fulcrum portion 37 of the hook member 32.

The elastic part 35 has a first elastic-part projecting portion 35*a* formed at a location thereof facing the separation regulating portion 38, and the first elastic-part projecting portion 35*a* protrudes toward the separation regulating portions 38. The elastic part 35 also has a second elastic-part projecting portion 35*b* formed at a location closer to the rotational axis 10 than the first elastic-part projecting portion 35*a*, and the second elastic-part projecting portion 35*b* protrudes toward the door body 31. Further, the door body 31 has a door-body-side projecting portion 31*c* formed on a side closer to the hook support portion 34 than the second elastic-part projecting portion 35*b*, and the door-body-side projecting portion 31*c* protrudes toward the elastic part 35. The second elastic-part projecting portion 35*b* engages the door-body-side projecting portion 31*c* to prevent the hook member 32 from moving in a direction toward the hook support portion 34 and coming off from the door body 31.

Figure 9:
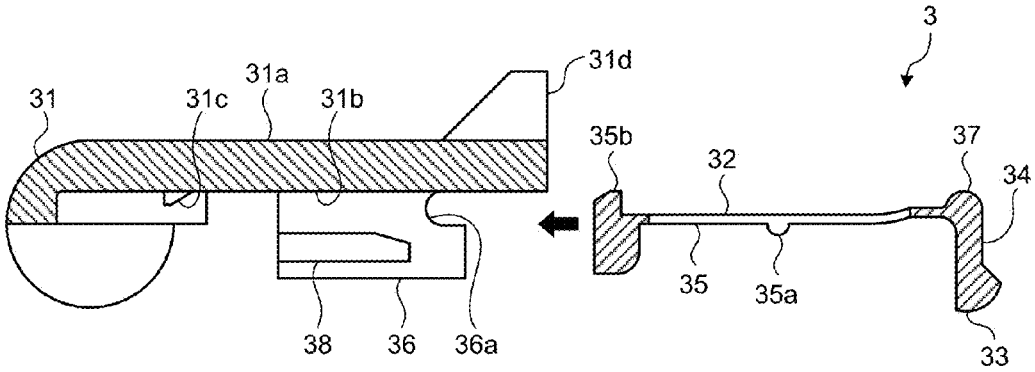
FIG. 9 is a view for explaining a sequence of attaching the hook member to the door body in the first embodiment.
Figure 10:
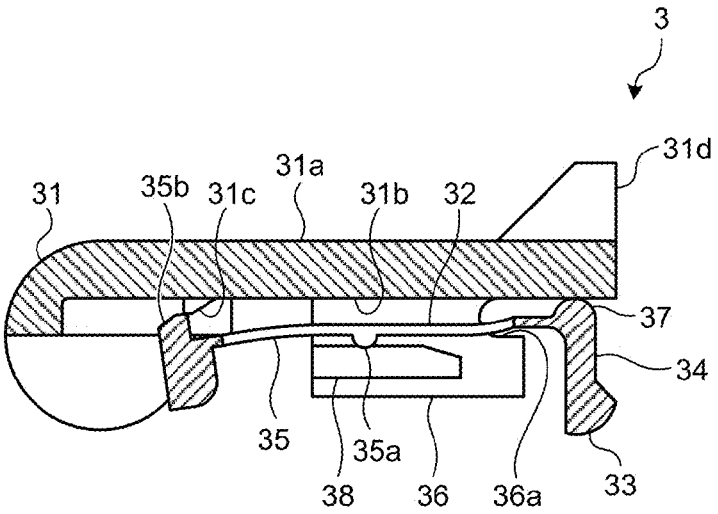
FIG. 10 is a view for explaining the sequence of attaching the hook member to the door body in the first embodiment.

Next, an explanation will be made as to a method of attaching the hook member 32 to the door body 31. FIGS. 9 and 10, which are views for explaining a sequence of attaching the hook member 32 to the door body 31 in the first embodiment, are sectional views take along line C-C indicated in FIG. 7. At first, as illustrated in FIG. 9, the hook member 32 is inserted between the support walls 36 formed on the door body 31, from a side of the second elastic-part projecting portion 35*b*. At this time, the elastic part 35 is inserted into the gap between the door body 31 and the separation regulating portions 38.

When the hook member 32 is inserted between the support walls 36, the second elastic-part projecting portion 35*b* formed on the hook member 32 abuts on the door-body-side projecting portion 31*c* formed on the door body 31. When the hook member 32 is further pushed in, as illustrated in FIG. 10, the elastic part 35 is elastically deformed so that the second elastic-part projecting portion 35*b* can climb over the door-body-side projecting portion 31*c*. In order that the elastic part 35 is elastically deformed smoothly, the abutment surface between the second elastic-part projecting portion 35*b* and the door-body-side projecting portion 31*c* is preferably a tapering surface having a cut-out formed thereon.

After the second elastic-part projecting portion 35*b* has climbed over the door-body-side projecting portion 31*c*, the elastic part 35 is restored from the elastically deformed state into the state illustrated in FIG. 3, and thereby the attaching of the hook member 32 is completed. When the hook member 32 is attached to the door main body 31, the fulcrum portion 37 fits in and is supported by the concave portions 36*a* formed on the support walls 36. When the hook member 32 moves toward the separation regulating portions 38 with the hook member 32 attached to the door body 31, the hook member 32 abuts on the separation regulating portions 38 at the first elastic-part projecting portions 35*a*.

Figure 11:
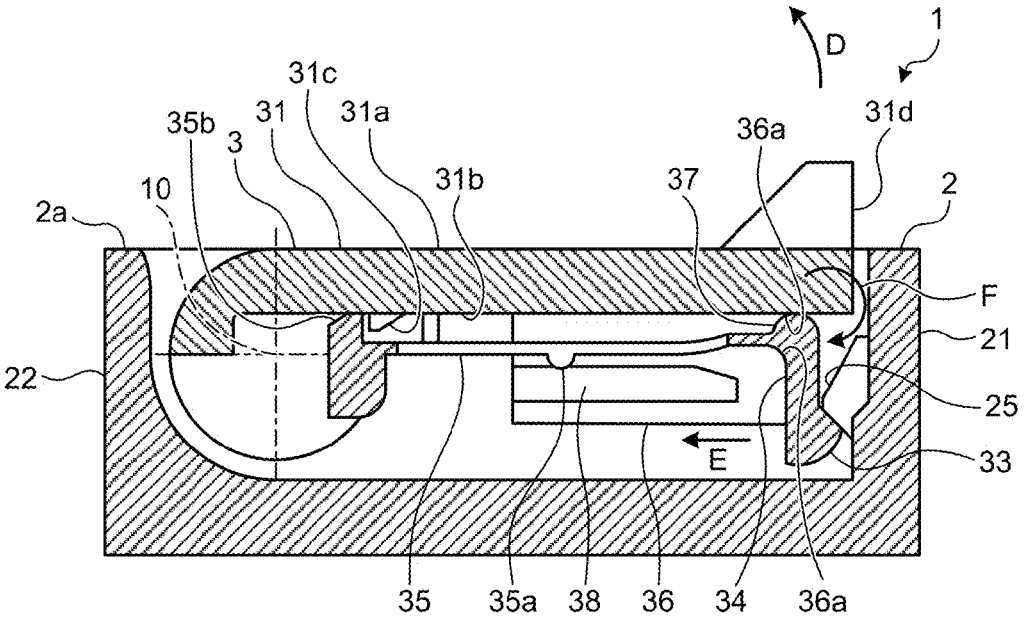
FIG. 11 is a view illustrating an operation of the hook member when the door of the door-equipped housing illustrated in FIG. 1 according to the first embodiment is opened.
Figure 12:
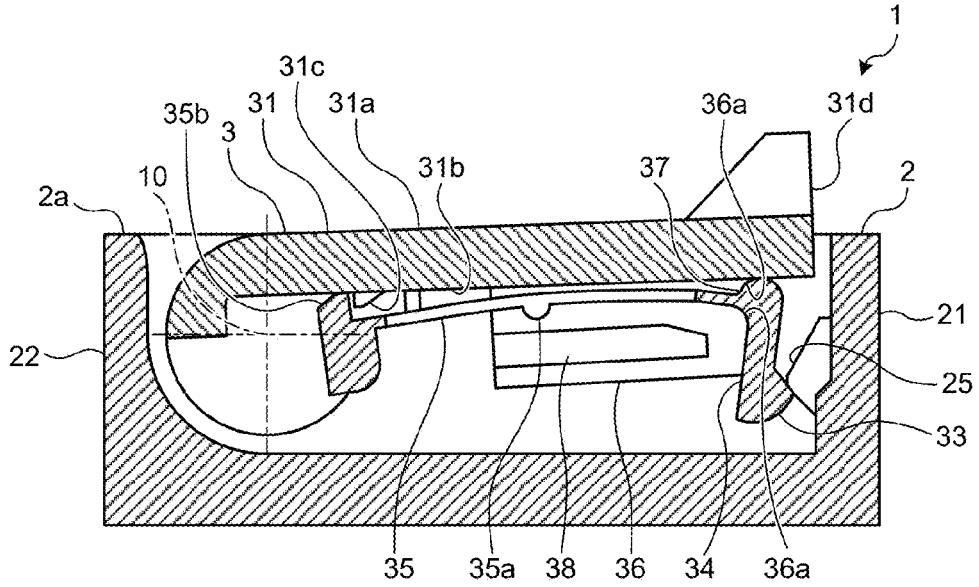
FIG. 12 is a view illustrating the operation of the hook member when the door of the door-equipped housing illustrated in FIG. 1 according to the first embodiment is opened.

Next, an explanation will be made as to an operation of the hook member 32 when the door 3 of the door-equipped housing 1 is opened. FIGS. 11 and 12 are views illustrating an operation of the hook member 32 when the door 3 of the door-equipped housing 1 illustrated in FIG. 1 according to the first embodiment is opened. When the door main body 31 is rotated in a direction indicated by an arrow D to open the door 3, the hook portion 33 attempts to move in a direction indicated by an arrow E so that the hook portion 33 can climb over the projecting portion 25.

The attempt of the hook portion 33 to move in the direction indicated by the arrow E applies a force to the hook support portion 34 to rotate the hook support portion 34 about the fulcrum portion 37 in a direction indicated by an arrow F. Since the hook support portion 34 is subjected to the force to rotate the hook support portion 34, as illustrated in FIG. 12, the elastic part 35 is elastically deformed to be convex toward the door body 31, such that the hook portion 33 can climb over the projecting portion 25 to allow the door 3 to be opened. In order that the elastic part 35 is elastically deformed to be convex toward the door main body 31, a gap needs to be present between the door body 31 and the elastic part 35.

Figure 13:
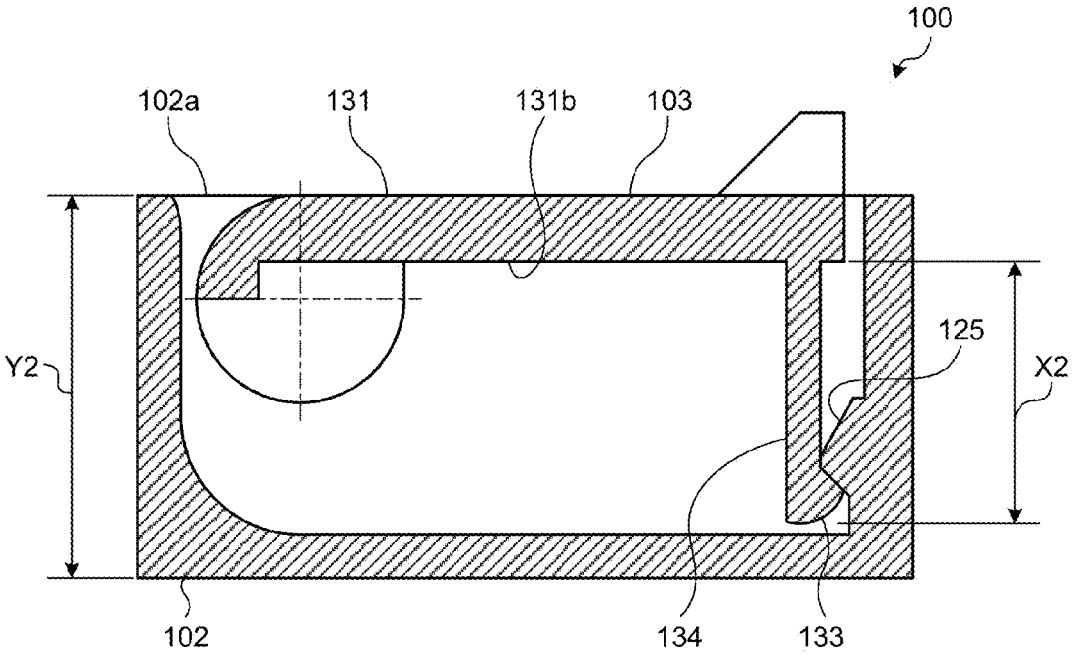
FIG. 13 is a sectional view of a door-equipped housing according to a comparative example.

Next, an explanation will be made as to a door-equipped housing according to a comparative example. FIG. 13 is a sectional view of a door-equipped housing 100 according to the comparative example. The door-equipped housing 100 according to the comparative example includes a box body 102 having an opening 102*a* formed therein, and a door 103 to close the opening 102*a* is rotatably supported by the box body 102, as in the door-equipped housing 1 according to the first embodiment.

In the door-equipped housing 100 according to the comparative example, the door 103 is not provided with the hook member, and, a hook support portion 134 is formed directly on a back surface 131*b* of a door body 131. In this door-equipped housing 100, when the door 103 is opened, the hook support portion 134 itself needs to bend so that a hook portion 133 formed at a tip of the hook support portion 134 can climb over a projecting portion 125 formed on the box body 102. Here, in order that the hook support portion 134 bends smoothly, the hook support portion 134 needs to have a given length or more. If the hook support portion 134 is too short, the hook support portion 134 requires a large force to bend, which hinders smooth opening/closing of the door 103.

However, a length X2 of the hook support portion 134 formed directly on the back surface 131*b* of the door body 131 cannot be larger than a thickness Y2 of the door-equipped housing 100. Accordingly, if the length X2 is set to ensure that the hook support portion 134 smoothly bends, it can be difficult to thin the door-equipped housing 100.

On the other hand, in the door-equipped housing 1 according to the first embodiment, when the door 3 is opened/closed, the hook support portion 34 is not bent, but the elastic part 35 of the hook member 32 is bent. As illustrated in FIG. 3, since the elastic part 35 extends in parallel with the opening 2*a* of the box body 2, a length Z1 of the elastic part 35 can be determined regardless of a thickness Y1 of the door-equipped housing 1. Further, since the hook support portion 34 does not need to bend, the hook support portion 34 can be shortened in accordance with the thickness Y1 of the door-equipped housing 1. Consequently, even if the length Z1 of the elastic part 35 is set to a value that allows the elastic part 35 to bend smoothly, the door-equipped housing 1 can be thinned reducing the thickness Y1. For example, in a case where the door-equipped housing 1 is used as a cover that covers a USB connection port or external storage medium insertion port on an operation panel of a machining tool, improvement in design and function can be achieved by reducing the thickness of the door-equipped housing 1.

Further, since the hook member 32 can be attached to the door body 31 by the insertion of the hook member 32 between the support walls 36 formed on the back surface 31*b* of the door body 31, it is possible to facilitate assembling of the door 3.

Further, since the door body 31 and the hook member 32 are separately formed, even if the hook member 32 is damaged, the door 3 can be reused by replacing the hook member 32 to thereby reduce the repair cost. Further, the door main body 31 and the hook member 32 may be made of different materials. Accordingly, the door body 31 to protect the inside of the box body 2 may be made of a material good in strength and durability, and the hook member 32, which is required to bend the elastic part 35, may be made of a material good in flexibility.

Further, the first elastic-part projecting portions 35*a*, which are formed on the elastic part 35, are defined as portions at which the elastic part 35 abuts on the separation regulating portions 38. The abutment of the first elastic-part projecting portions 35*a* on the separation regulating portions 38 allows abutment of the second elastic-part projecting portion 35*b* on the back surface 31*b* of the door body 31. As a result, it is possible to prevent the second elastic-part projecting portion 35*b* from climbing over the door-body-side projecting portion 31*c*, and thereby prevent the hook member 32 from coming off from the door body 31.

Here, in the first embodiment, the projecting portion 25 is formed on the first wall 21, and the hook member 32 is disposed such that the elastic part 35 extends from the first wall 21 toward the second wall 22, but the projecting portion 25 may be formed on the third wall 23 or fourth wall 24, in which case the hook member 32 may be disposed such that the elastic part 35 extends from the third wall 23 toward the fourth wall 24 to allow the hook portion 33 to engage the projected portion 25.

Further, the shapes of the door main body 31 and the opening 2*a* are not limited to the illustrated rectangular shapes. The shape of the door body 31 may employ various shapes, including a circular shape, an elliptical shape, and a polygonal shape other than the rectangular shapes.

Further, in the illustrated example, the box body 2 includes the bottom surface opposed to the opening 2*a*, but a box body 2 having a tubular shape not having the bottom surface may be used.

Second Embodiment

Figure 14:
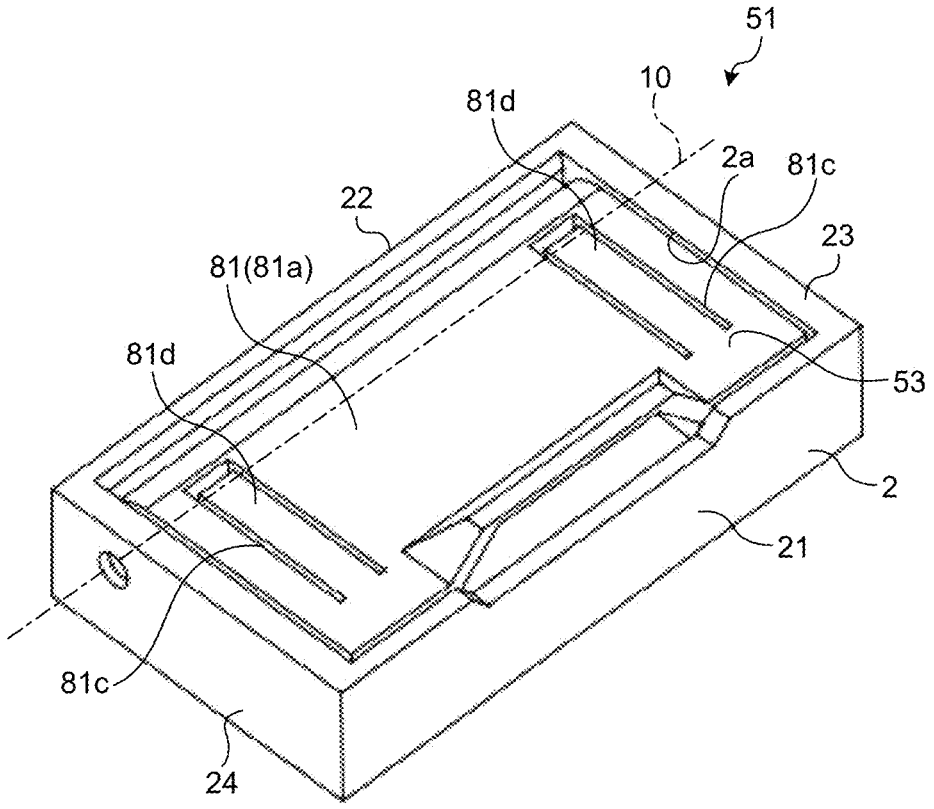
FIG. 14 is an exterior perspective view of a door-equipped housing according to a second embodiment of the present invention.
Figure 15:
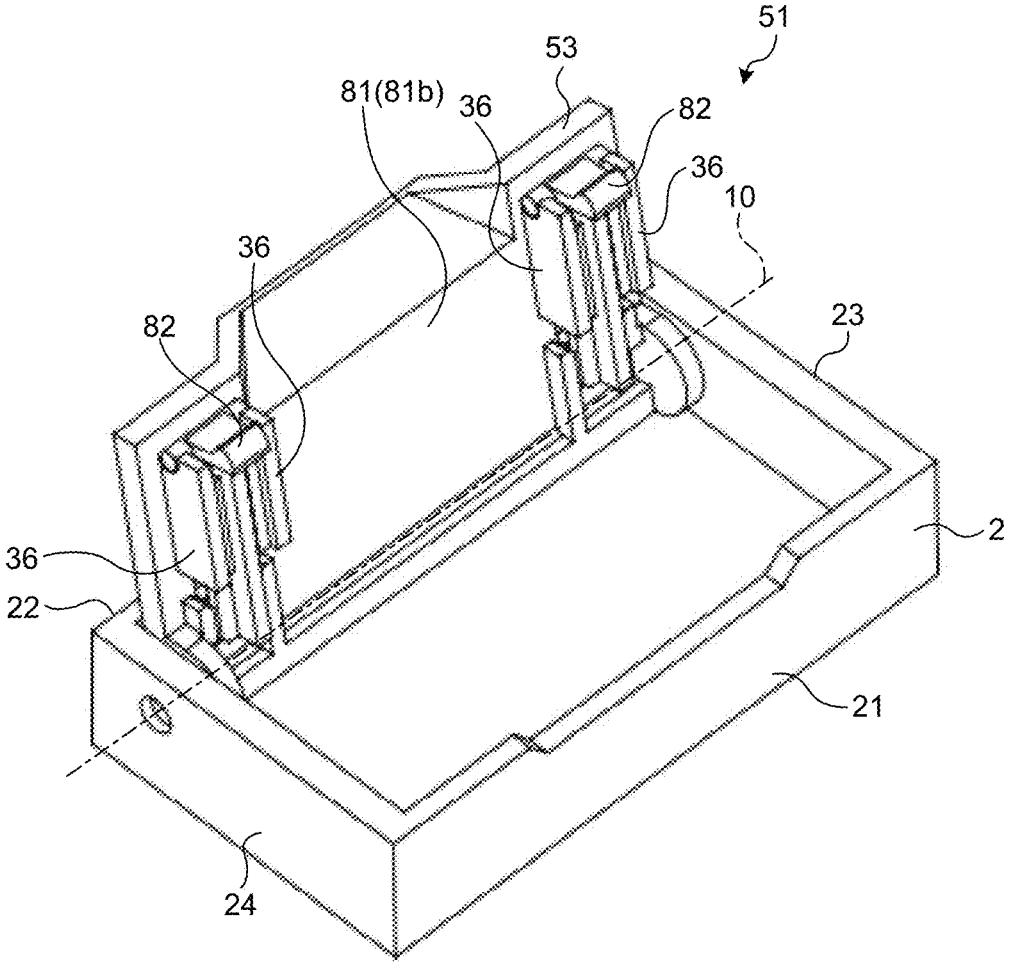
FIG. 15 is a view illustrating a state where the door of the door-equipped housing illustrated in FIG. 14 in the second embodiment is opened.
Figure 16:
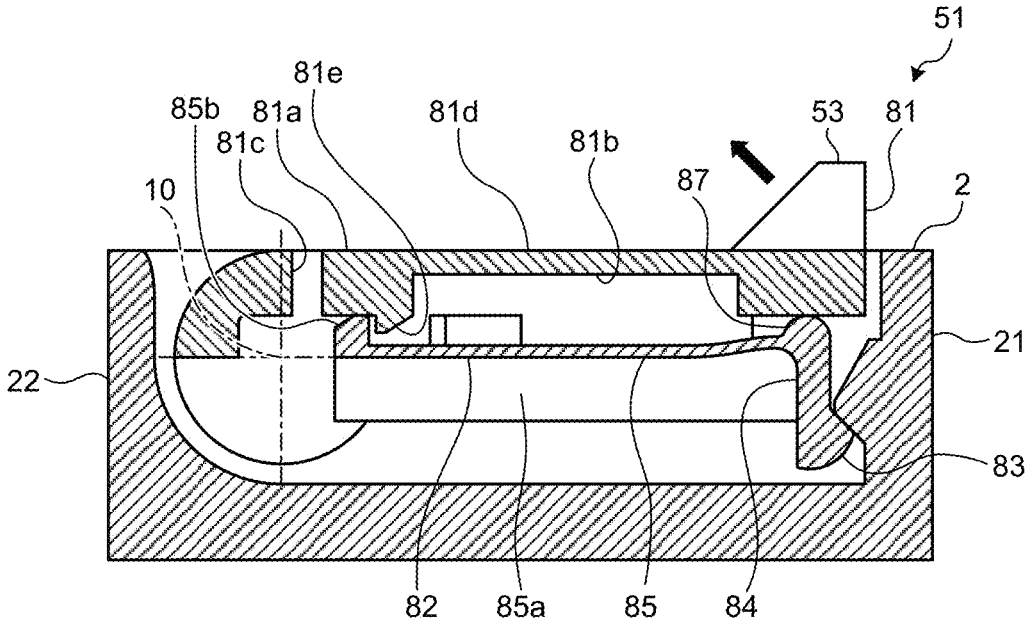
FIG. 16 is a sectional view of the door-equipped housing illustrated in FIG. 14 in the second embodiment.

FIG. 14 is an exterior perspective view of a door-equipped housing according to a second embodiment of the present invention. FIG. 15 is a view illustrating a state where the door of the door-equipped housing illustrated in FIG. 14 according to the second embodiment is opened. FIG. 16 is a sectional view of the door-equipped housing illustrated FIG. 14 according to the second embodiment. Here, the constituent elements corresponding to those of the first embodiment are denoted by the same reference symbols, and their description will be omitted.

The door-equipped housing 51 according to the second embodiment includes a box body 2 having an opening 2*a* formed therein, and a door 53 to close the opening 2*a* is supported by the box body 2 such that the door 53 is rotatable about a rotational axis 10, as in the first embodiment. The door 53 includes a rectangular door body 81 to close the opening 2*a*, and hook members 82.

The door body 81 has through grooves 81*c* formed therethrough from a front surface 81*a* to a back surface 81*b*, and the through groove 81*c* has a folded shape opened toward a first wall 21 having a projecting portion 25 formed thereon. In other words, the through groove 81*c* has a U-shape as viewed in plan. According to the second embodiment, regions of the door main body 81, which are surrounded by the through groove 81*c*, are flexible parts 81*d* to bend in opening/closing the door 53. The flexible part 81*d* extends in parallel with the opening 2*a* as the door 53 closes the opening 2*a*. Support walls 36 formed on the rear face 81*b* of the door main body 81 are present on the opposite sides of the through groove 81*c*.

Figure 17:
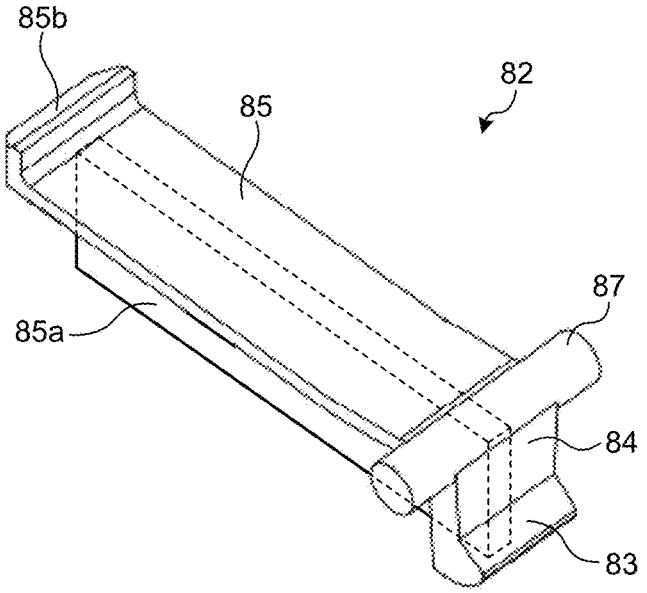
FIG. 17 is a perspective view illustrating a hook member in the second embodiment.

FIG. 17 is a perspective view of the hook member 82 according to the second embodiment. The hook member 82 is inserted between the support walls 36, and thereby attached to the door body 81. The hook member 82 has a hook portion 83 formed thereon to engage the projecting portion 25, and the hook portion 83 is located on a deeper side than the projecting portion 25 formed on the first wall 21 of the box body 2, as the door 53 closes the opening 2*a*. The hook member 82 includes a hook support portion 84 extending from the hook portion 83 toward the door body 81.

The hook member 82 includes an extending part 85 extending from an end of the hook support portion 84 on a side of the door body 81 in a direction parallel with the opening 2*a* away from the surface of the first wall 21 having the projecting portion 25 formed thereon. The extending part 85 faces the flexible part 81*d*. A rib 85*a* is formed on the extending part 85, and protrudes in a direction away from the door body 81.

At a connecting portion between the hook support portion 84 and the extending part 85, a protruding fulcrum portion 87 is formed on a side closer to the door body 81 than the extending part 85. Since the fulcrum portion 87 protrudes toward the door body 81, a gap is defined between the extending part 85 and the door body 81.

The extending part 85 has an extending-part projecting portion 85*b* formed at an end opposite to a side on which the hook support portion 84 formed, and the extending-part projecting portion 85*b* protrudes toward the door body 81. The extending-part projecting portion 85*b* abuts on an end of the flexible part 81*d* of the door body 81 on the folded portion side of the through groove 81*c*.

Further, the door body 81 has a door-body-side projecting portion 81*e* formed on a side closer to the hook support portion 84 than the extending-part projecting portion 85*b*, and the door-body-side projecting portion 81*e* protrudes toward the extending part 85. The extending part projected portion 85*b* engages the door-body-side projecting portion 81*e* to thereby prevent the hook member 82 from moving in a direction toward the hook support portion 84 and coming off from the door body 81.

Figure 18:
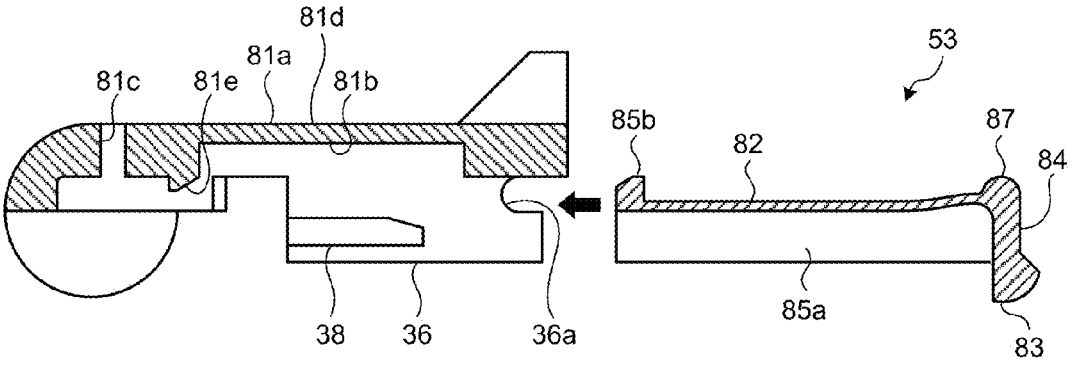
FIG. 18 is a view for explaining a sequence of attaching the hook member to a door body in the second embodiment.
Figure 19:
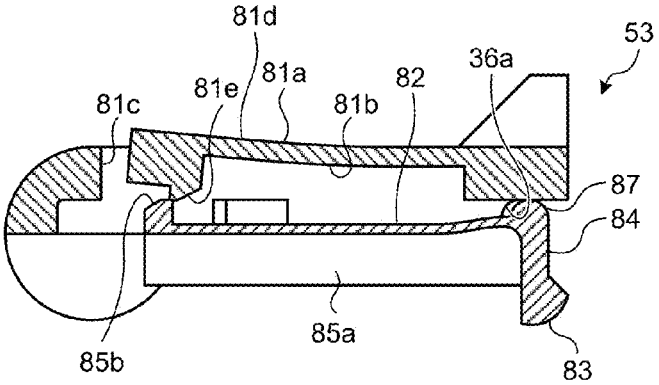
FIG. 19 is a view for explaining the sequence of attaching the hook member to the door body in the second embodiment.

Next, an explanation will be made as to a method of attaching the hook member 82 to the door body 81. FIGS. 18 and 19 are views for explaining a sequence of attaching the hook member 82 to the door body 81 according to the second embodiment. At first, as illustrated in FIG. 18, the hook member 82 is inserted between the support walls 36 formed on the door body 81, from an end opposite to the hook support portion 84. At this time, the extending part 85 is inserted into the gap between the door body 81 and separation on regulating portions 38.

When the hook member 82 is inserted between the support walls 36, the extending-part projecting portion 85*b* formed on the hook member 82 abuts on the door-body-side projecting portion 81*e* formed on the door body 81. When the hook member 82 is further pushed in, as illustrated in FIG. 19, the flexible part 81*d* is elastically deformed so that the extending-part projecting portion 85*b* can climb over the door-body-side projecting portion 81*e*. In order that the flexible part 81*d* is elastically deformed smoothly, the abutment surface between the extending-part projecting portion 85*b* and the door-body-side projecting portion 81*e* is preferably a tapering surface having a cut-out formed thereon.

After the extending-part projecting portion 85*b* has climbed over the door main body side projected portion 81*e*, the flexible part 81*d* is restored from the elastically deformed state into the state illustrated in FIG. 16, and thereby the attaching of the hook member 82 is completed. When the hook member 82 is attached to the door main body 81, the fulcrum portion 87 fits in and is supported by concave portions 36*a* formed on the support walls 36.

Figure 20:
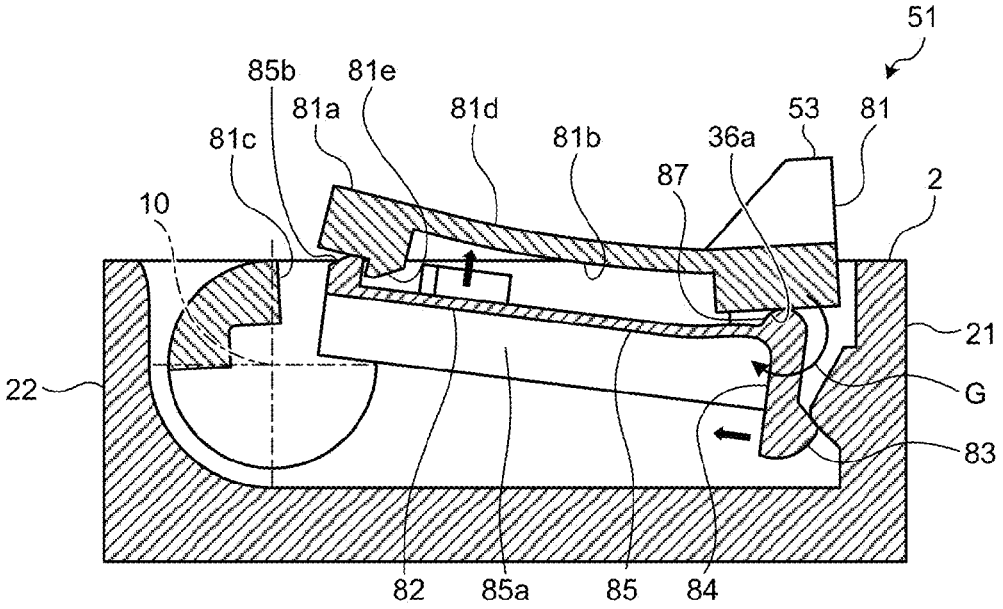
FIG. 20 is a view illustrating an operation of the hook member and a flexible part when the door of the door-equipped housing illustrated in FIG. 14 in the second embodiment is opened.

Next, an explanation will be made as to an operation of the hook member 82 and the flexible part 81*d* when the door 53 of the door-equipped housing 51 is opened. FIG. 20 is view illustrating an operation of the hook member 82 and the flexible part 81*d* when the door 53 of the door-equipped housing 51 illustrated in FIG. 14 in the second embodiment is opened.

When the door main body 81 is rotated to open the door 53, force is applied to the hook support portion 84 to rotate the hook support portion 84 about the fulcrum portion 87 in a direction indicated by an arrow G in order that the hook portion 83 can climb over the projected portion 25. Since the hook support portion 84 is subjected to the force to rotate the hook support portion 84, as illustrated in FIG. 20, the flexible part 81*d* is pushed by the extending part projected portion 85*b* and elastically deformed, such that the door 53 can be opened.

Also in the second embodiment, when the door 53 is opened/closed, the hook support portion 84 is not bent, but the flexible part 81*d* extending in parallel with the opening 2*a* of the box body 2 is bent. Consequently, even if the length of the flexible part 81*d* is set to a value that allows the flexible part 81*d* to bend smoothly, the door-equipped housing 51 can be thinned reducing the thickness.

Further, since the hook member 82 can be attached by inserting the hook member 82 between the support walls 36 formed on the back surface 81*b* of the door body 81, it is possible to facilitate assembling of the door 53.

Further, since the door main body 81 and the hook member 82 are separately formed, even if the hook member 82 is damaged, the door 53 can be reused by replacing the hook member 82 to thereby reduce the repair cost. Further, the door main body 81 and the hook member 82 may be made of different materials.

Here, in the second embodiment, the projecting portion 25 is formed on the first wall 21, and the hook member 82 is disposed such that the extending part 85 extends from the first wall 21 toward the second wall 22, but the projecting portion 25 may be formed on the third wall 23 or fourth wall 24, in which case the through grooves 81*c* are formed in the door main body 81 such that the through groove has a folded shape opened toward the third wall 23 or fourth wall 24. Further, the hook member 82 may be disposed such that the extending part 85 extends from the third wall 23 toward the fourth wall 24 to allow the hook portion 83 to engage the projecting portion 25.

Further, the shapes of the door main body 81 and the opening 2*a* are not limited to the illustrated rectangular shapes. The shape of the door body 31 may employ various shapes, including a circular shape, an elliptical shape, and a polygonal shape other than the rectangular shapes.

Further, in the illustrated example, the box body 2 includes the bottom surface opposed to the opening 2*a*, but a box body 2 having a tubular shape not having the bottom surface may be used.

Further, in the first and second embodiments described above, the flexible part has been discussed as being bent when the door is opened, but the flexible part is bent to allow for climbing over the projecting portion 25 when the door is closed.

The configurations illustrated in the above embodiments are mere examples of the contents of the present invention, and they may be combined with other known techniques. Further, the configurations may be partly omitted or changed without departing from the spirit of the present invention.

REFERENCE SIGNS LIST

1 door-equipped housing, 2 box body, 2*a* opening, 3 door, 10 rotational axis, 21 first wall, 22 second wall, 23 third wall, 24 fourth wall, 25 projecting portion, 31 door body, 31*a* front surface, 31*b* back surface, 31*c* door-body-side projecting portion, 31*d* knob member, 32 hook member, 33 hook portion, 34 hook support portion, 35 elastic part (flexible part), 35*a* first elastic-part projecting portion, 35*b* second elastic-part projecting portion, 36 support wall, 36*a* concave portion (door-side support portion), 37 fulcrum portion, 38 separation regulating portion, 51 door-equipped housing, 53 door, 81 door body, 81*a* front surface, 81*b* back surface, 81*c* through groove, 81*d* flexible part, 81*e* door-body-side projecting portion, 82 hook member, 83 hook portion, 84 hook support portion, 85 extending part, 85*a* rib, 85*b* extending part projecting portion, 87 fulcrum portion, 100 door-equipped housing.

The invention claimed is:

1. A door-equipped housing comprising:

a box body having an opening formed on one side thereof; and a door to close the opening, the door being supported by the box body to be rotatable state about a rotational axis, wherein the box body has a projecting portion formed on an inside of a wall surface of the box body, the wall surface extending from the opening toward a deep side of the box body, and the door includes:

a door body having a plate-shape to close the opening; and a hook member supported by the door body, wherein the hook member includes:

a hook portion to engage the projecting portion for preventing the door from opening, the hook portion being located on a deeper side of the box body than the projecting portion as the door closes the opening;

a hook support portion extending from the hook portion toward the door body;

a flexible part comprising:

a longitudinal direction extending in a lengthwise direction of the flexible part, and a width direction, that is perpendicular to the longitudinal direction, extending away from the door body and towards the projecting portion, the flexible part extending from an end of the hook support portion on a side of the door body in the longitudinal direction away from the wall surface having the projecting portion formed thereon as the door closes the opening, the flexible part being disposed with a gap defined between the flexible part and the door body; and a fulcrum portion disposed at a connecting portion, the connecting portion being a portion where the hook support portion and the flexible part are joined, the fulcrum portion protruding toward the door body such that the gap is defined between the flexible part and the door body, wherein a length of the flexible part in the longitudinal direction is greater than a length of the hook support portion in the width direction of the flexible part, and a thickness of the hook support portion in the longitudinal direction of the flexible part is greater than a thickness of the flexible part in the width direction, such that the flexible part is more elastically deformable than the hook support portion, the flexible part, in response to a movement of the hook portion to climb over the projecting portion during an opening/closing operation of the door, bends to be convex toward the door body to allow the hook support portion to turn about the fulcrum portion without the hook support portion undergoing bending deformation, and wherein only one side of the flexible part in the longitudinal direction is fixed to the hook support portion.

2. The door-equipped housing according to claim 1, wherein the door body has a door-side support portion formed thereon, the door-side support portion supporting the fulcrum portion of the hook member.

3. The door-equipped housing according to claim 1, wherein the door body has a separation regulating portion formed thereon, the separation regulating portion abutting on the flexible part from a side opposite to the door body, to regulate a movement of the flexible part in a direction away from the door body.

4. The door-equipped housing according to claim 3, wherein the flexible part has a first elastic-part projecting portion formed thereon, the first elastic-part projecting portion protruding toward the separation regulating portion.

5. The door-equipped housing according to claim 1, wherein the flexible part has a second elastic-part projecting portion formed thereon, the second elastic-part projecting portion protruding toward the door body, and wherein the door body has a door-body-side projecting portion formed thereon, the door-body-side projecting portion protruding toward the flexible part, on a side closer to the hook support portion than the second elastic-part projecting portion, to prevent the hook member from moving in a direction toward the hook support portion.

6. A door-equipped housing comprising:

a box body having an opening formed on one side thereof; and a door to close the opening, the door being supported by the box body to be rotatable state about a rotational axis, wherein the box body has a projecting portion formed on an inside of a wall surface of the box body, the wall surface extending from the opening toward a deep side of the box body, the door includes:

a door body to close the opening; and a hook member supported by the door body, wherein the hook member includes:

a hook portion to engage the projecting portion for preventing the door from opening, the hook portion being located on a deeper side of the box body than the projecting portion as the door closes the opening;

a hook support portion extending from the hook portion toward the door body; and an extending part extending from an end of the hook support portion on a side of the door body in a direction parallel with the opening away from the wall surface having the projecting portion formed thereon as the door closes the opening, the extending part being disposed with a gap defined between the extending part and the door body, the door body having a through groove formed therethrough, the through groove having a folded shape opened toward a wall part having the projecting portion formed thereon, the hook member being disposed in such a position that the extending part faces a region of the door body surrounded by the through groove, and the region of the door body surrounded by the through groove is a flexible part to bend together with a movement of the hook portion to climb over the projecting portion during an opening/closing operation of the door, wherein the through groove and the flexible part are formed as integral and continuous portions of the door body.

7. The door-equipped housing according to claim 6, wherein the door body has a door-side support portion formed thereon, the door-side support portion supporting a connecting portion, the connecting portion being a portion where the hook support portion and the extending part are joined.

8. The door-equipped housing according to claim 6, wherein the door body has a separation regulating portion formed thereon, the separation regulating portion abutting on the extending part from a side opposite to the door body, to regulate a movement of the extending part in a direction away from the door body.

9. The door-equipped housing according to claim 6, wherein the extending part has an extending-part projecting portion formed thereon, the extending-part projecting portion protruding toward the door body, and wherein the door body has a door-body-side projecting portion formed thereon, the door-body-side projecting portion protruding toward the extending part, on a side closer to the hook support portion than the extending-part projecting portion, to prevent the hook member from moving in a direction toward the hook support portion.

* * * * *